United States Patent [19]

Greene et al.

[11] 4,439,309

[45] Mar. 27, 1984

[54] TWO-STAGE HYDROGEN DONOR SOLVENT CRACKING PROCESS

[75] Inventors: Marvin I. Greene, Oradell; Abraham P. Gelbein, Morristown, both of N.J.

[73] Assignee: Chem Systems Inc., Tarrytown, N.Y.

[21] Appl. No.: 423,657

[22] Filed: Sep. 27, 1982

[51] Int. Cl.[3] ..... C10G 69/06

[52] U.S. Cl. ..... 208/51; 208/50; 208/56

[58] Field of Search ..... 208/50, 51, 56

[56] References Cited

U.S. PATENT DOCUMENTS

| | | | |
|---|---|---|---|
| 2,843,530 | 7/1958 | Langer et al. | 208/56 |
| 2,953,513 | 9/1960 | Langer | 208/56 |
| 4,051,012 | 9/1977 | Plumlee et al. | 208/8 |
| 4,115,246 | 9/1978 | Sweeny | 208/56 |
| 4,176,046 | 11/1979 | McConaghy | 208/56 |
| 4,213,846 | 7/1980 | Sooter et al. | 208/56 |
| 4,294,686 | 10/1981 | Fisher | 208/56 |
| 4,363,716 | 12/1982 | Greene et al. | 208/80 |

*Primary Examiner*—Curtis R. Davis

*Attorney, Agent, or Firm*—Marvin Bressler

[57] ABSTRACT

A process for the cracking of carbonaceous liquid feedstock employing a hydrogen donor solvent, derived from the feedstock, in a two-stage cracking operation is disclosed.

34 Claims, 2 Drawing Figures

TWO-STAGE HYDROGEN DONOR SOLVENT CRACKING PROCESS

BACKGROUND OF THE DISCLOSURE

1. Field of the Invention

The instant invention is directed to a process for cracking heavy carbonaceous liquid feedstock using hydrogen donor solvent derived from the feedstock. More particularly, the instant invention is directed to a process for cracking heavy carbonaceous liquid feedstock using a hydrogen donor solvent, derived from the feedstock, in a two-stage operation.

2. Background of the Prior Art

Until very recently, the cracking of heavy carbonaceous liquid feedstock by use of hydrogen donor solvent cracking was limited to either producing hydrogen donor solvent boiling above 370° C. by (i) reacting polynuclear aromatics with hydrogen in the presence of a conventional hydrogenation catalyst to convert the polynuclear aromatics to polynuclear hydroaromatics or (ii) by providing an external source of hydroaromatic donor solvent or donor solvent precursor. The use of these high boiling donor solvents creates inherent difficulty in that they possess less hydrogen available per unit weight than hydrogen donor solvents boiling at lower temperature and that they either must be derived from an external source or be produced from the cracking of the subject feedstocks by the donor solvent cracking process.

Illustrative of prior art practice involving the use of heavy, i.e., high boiling hydrogen donor, solvents are the following:

U.S. Pat. No. 2,953,513, Langer, Sept. 20, 1960 employs heavy, that is, high boiling, solvents. The solvents employed by Langer are not native to the feedstock used in the instant invention in sufficient concentration to render them active as hydrogen donors. The key components in the feedstock disclosed by Langer cannot be readily produced from other hydrocarbon species.

U.S. Pat. No. 4,051,012, Plumlee, Sept. 27, 1977, discloses a process specific to cold feedstock which exhibit synergism between a quinone catalyst and oxygenated species that exist in coal-derived donor solvent. It is noted that the carbonaceous feedstocks of this invention are largely hydrocarbons that do not contain any significant quantity of oxygenated species.

U.S. Pat. No. 2,843,530, Langer, July 15, 1958, discloses the use of makeup hydrogen donor solvent derived from an external source such as tars, cyclic oils and lube oil extracts. Obviously, such a system does not provide the advantages of internally generated solvent. It is noted that this external derived hydrogen donor solvent does not include naphthalene, a very desirable precursor for hydrogen donor solvents.

U.S. Pat. No. 3,867,275, Gleim, Feb. 18, 1975, comments on the expense and difficulty of obtaining two-ring aromatic solvents, solvents of the type that make excellent hydrogen donors.

Gorin et al, Proc, 8th World Pet. Congress, Preprints Session No. PD10 (5), 44 (1971), discloses a highly aromatic solvent derived from a coal feedstock.

Representatives, also, of the state of the art are U.S. Pat. No. 3,849,287, Gleim, Nov. 19, 1974; U.S. Pat. No. 3,336,411, Benham, Aug. 15, 1967; U.S. Pat. No. 3,775,498, Thompson, Nov. 27, 1973; U.S. Pat. No. 2,585,899; Langhor's, Feb. 12, 1952; U.S. Pat. No. 3,504,045, Scharf, Mar. 31, 1970; U.S. Pat. No. 4,176,046, McConaghy, Nov. 27, 1979; U.S. Pat. No. 4,115,246, Sweany, Sept. 19, 1978; and U.S. Pat. No. 4,213,846, Sooter et al, July 22, 1980; Doyle, "Desulfurization Via Hydrogen Donor Reactions:, "Division of Petroleum Chemistry, ACS, Chicago Meeting, Aug. 24–29, 1975, p 165; Neavel, "Liquifaction of Coal in Hydrogen-Donor and Hydrogen Non-Donor Vehicles", Fuel, 1976, Vol. 55, July, p. 2–37; Carlson, "Thermal Hydrogenation", Ind. & Eng. Chem., Vol. 50, No. 7, p. 1067; "Aromatic Hydrocarbons"—pp. 230–236, Production and Separation of alkylnaphthalenes, Marshal Sittig, Editor, 1976, Noyes Data Corp., Parkridge, N.J.

A recent reference, U.S. Pat. No. 4,294,686, Fisher et al., Oct. 13, 1981, overcomes one of the principal problems of the prior art. That is, it provides for employing recycled hydrogen donor solvent having a boiling point below 370° C. in the cracking of heavy carbonaceous liquids. However, when certain feedstocks are provided the process disclosed does not provide sufficient recycle solvent to maintain material balance for a continuous process.

To overcome this defect, a still more recent reference, U.S. patent application, Ser. No. 238,344 filed Feb. 22, 1980, now U.S. Pat. No. 4,363,716 overcomes this defect in the '686 patent. The application, assigned to the same assignee as the present application, discloses a liquid phase process, in total material balance with respect to recycled solvents, for cracking heavy carbonaceous liquid feedstocks using a hydrogen donor solvent having a boiling range of from 175° to 300° C.

This patent application represents a significant advance in the art. However, certain possibilities for improvement of the process of this application have been identified. In the process disclosed in application, Ser. No. 238,344, there is a reduction in coking compared to the disclosures of the prior art. However, there is still some tendency towards coking. In that the carbonaceous liquid feedstock of this invention have high coking propensity, and are difficult to upgrade by the processing steps of the prior art, there is still need for improvement in the processing of heavy carbonaceous liquid feedstocks.

SUMMARY OF THE INVENTION

The instant invention is directed to a process for cracking heavy carbonaceous feedstock utilizing a two-stage hydrogen donor solvent in which low boiling solvent is fully generated from the cracked feedstock. This process overcomes the disadvantageous of the latest and best teachings of the prior art, in that it permits long term operability by overcoming the problem of coke deposition.

The process of this invention results in the production of a metals free, low coking propensity, distillate product having a boiling temperature range, at atmospheric pressure, of between 40° and 540° C. The process is characterized by a yield of greater than 90 liquid percent, based on the heavy carbonaceous liquid feedstock.

In accordance with the instant invention a process is provided for processing carbonaceous liquids including the steps of:

(a) separating a carbonaceous liquid to provide a first middle distillate fraction having boiling temperature, at atmospheric pressure, in the range of between 175° and 300° C. and a first residual fraction having an initial boiling temperature, at atmospheric pressure in the range of between 260° and 540° C.;

(b) supplying a first reaction mixture comprising a recycle stream of hydrogen donating material and said first residual fraction, recovered in step (a), to a first cracking reaction zone;

(c) reacting said first reaction mixture in said first cracking reaction zone at a temperature in the range of between 250° and 800° C. and a pressure in the range of between 30 and 200 atmospheres for a period in the range of between 15 seconds and 5 hours whereby a first cracked product stream is obtained;

(d) separating said first cracked product stream into a second middle distillate fraction having a boiling temperature, at atmospheric pressure, in the range of between 175° C. and 300° C., a second residual fraction having an initial boiling temperature at atmospheric pressure, in the range of between 260° and 540° C.; and a first distillate hydrogen enriched stream having an initial boiling temperature, at atmospheric pressure, in the range of between 40° and 540° C.;

(e) supplying a second reaction mixture comprising a recycle stream of hydrogen donating material and said second residual fraction, recovered in step (d), to a second cracking reaction zone;

(f) reacting said second reaction mixture in said second cracking reaction zone at a temperature in the range of between 250° and 800° C. and a pressure in the range of between 30 and 200 atmospheres for a period in the range of between 15 seconds and 5 hours whereby a second cracked product stream is obtained;

(g) separating said second cracked product stream into a third middle distillate fraction, having a boiling temperature, at atmospheric pressure, in the range of between 175° and 300° C., a third residual fraction having an initial boiling temperature, at atmospheric pressure, of at least 425° C. and a second distillate hydrogen enriched stream having an initial boiling temperature, at atmospheric pressure, in the range of between 40° and 540° C.;

(h) hydrogenating said second, said third and a fourth middle distillate fractions, in the presence of gaseous hydrogen and a solid base metal catalyst whereby a hydrogen donating material comprising at least 30% by weight of two and three ring hydroaromatics having ten to twenty carbon atoms per molecule is formed;

(i) dehydroisomerizing said first middle distillate fraction in the presence of gaseous hydrogen and a reforming catalyst whereby said fourth middle distillation fraction comprises at least 30% by weight of two and three ring aromatics having ten to twenty carbon atoms per molecule;

(i) recycling said hydrogen donating material formed in step (h), to said first cracking reaction zone, in accordance with step (b), and to said second cracking reaction zone, in accordance with step (e); and (k) recovering said first distillate hydrogen enriched stream and said second distillate hydrogen enriched stream as products.

In a further embodiment of the instant invention, a process is provided wherein the steps of hydrogenating, step (h), and dehydroisomerizing, step (i), are replaced with the step of hydroisomerizing the first, second and third middle distillate fractions to form hydrogen donating material.

BRIEF DESCRIPTION OF THE DRAWING

The instant invention may be better understood by reference to the accompanying drawings of which.

DETAILED DESCRIPTION

Figure 1:
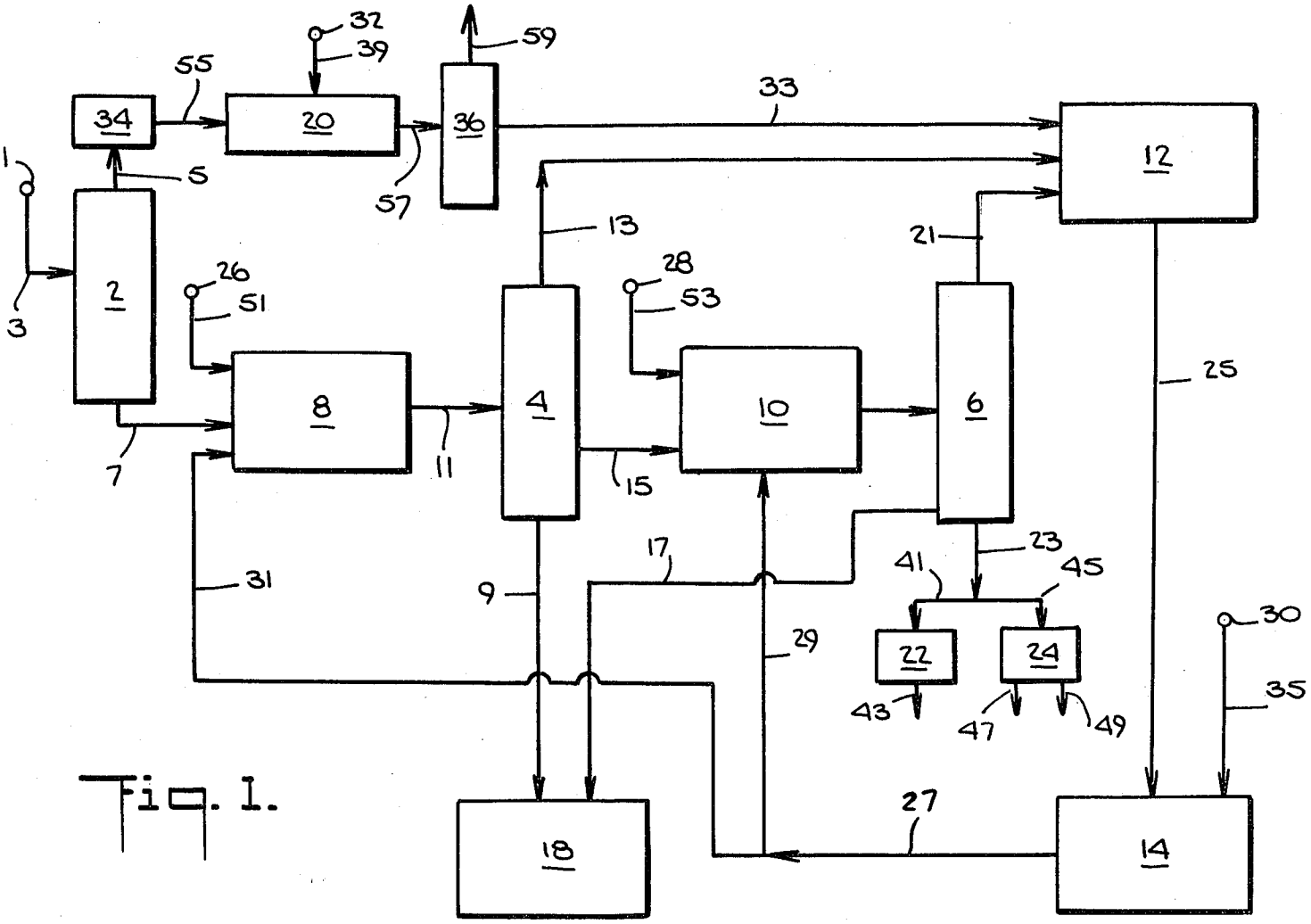
FIG. 1 is a schematic representation of a preferred embodiment of the process of the instant invention.

Turning to FIG. 1, a heavy carbonaceous liquid feedstock 1, which in a preferred embodiment is a heavy petroleum crude, is transmitted through conduit 3 to a first separator 2. The separator 2 is preferably a distillation column. The feedstock crude 1 is separated, preferably by distillation, into a first middle distillate fraction having a boiling temperature, at atmospheric pressure, in the range of between 175° and 300° C. and a first residual fraction having an initial boiling temperature, at atmospheric pressure, in the range of between 260° and 540° C. The first middle distillate fraction is removed from the separator 2 through communicating conduit 5. The first residual fraction exits the separator 2 through another conduit in communication with the separator 2, conduit 7.

Conduit 7, in communication, at its downstream terminus, with a first cracking reaction zone 8, supplies the first residual fraction thereto. The cracking zone 8 is preferably a cracking reactor with which a second conduit, conduit 31, also communicates at its downstream end. The first residual fraction and the conduit 31 provides a recycle stream of hydrogen donating material, to be described hereinafter. The first residual fraction and the hydrogen-donating material comprise the first reaction mixture. The hydrogen donating material reacts with the first residual fraction in the cracking zone 8. The weight ratio of hydrogen-donating material to first residual fraction is preferably at least 0.25 part of hydrogen donating material per part of residual of first residual fraction. More preferably, the weight ratio of hydrogen donating material to first residual fraction is at least 0.4:1.

In another preferred embodiment, the first reaction mixture includes a third constituent, gaseous hydrogen. In this embodiment gaseous hydrogen is supplied at a rate such that the hydrogen comprises between 0.005 to 0.05 part by weight based on the total weight of the first reaction mixture. The hydrogen 26 is supplied into the first cracking reaction zone 8 by means of conduit 51 in communication with cracking reactor 8.

The first reaction mixture is reacted in the reactor 8 at a temperature in the range of between 250° and 800° C., more preferably, between 300° and 600° C. and most preferably, between 400° and 450° C., for a period in the range of between 15 seconds and 5 hours. More preferably, the total residence time is from 1 minute to 4 hours. Most preferably, this residence time is in the range of between 5 minutes and 2 hours. The pressure in the first cracking reaction zone 8 is maintained in a range of between 30 and 200 atmospheres. More preferably, the pressure in the reactor 8 is in the range of between 40 and 100 atmospheres.

The product of the reaction in the cracking reaction zone 8 is a first cracked product stream which is removed from zone 8 through a conduit 11.

The first cracked product stream is transmitted, in conduit 11, to a second separator 4. The separator 4, preferably a distillation column, effects the separation, preferably by distillation, of the first cracked product stream into three fractions. One of these fractions, leaving the separator 4 through conduit 13, is the second middle distillate fraction. The second middle distillate fraction has a boiling temperature, at atmospheric pressure, in the range of between 175° and 300° C.

A second residual fraction is removed from the separator 4 through conduit 15. The second residual fraction has an initial boiling temperature, at atmospheric pressure, in the range of between 260° and 540° C.

The third fraction is a first distillate hydrogen enriched stream. This stream, which has an initial boiling temperature, at atmospheric pressure, in the range of between 40° and 540° C., is removed from the separator 4 through conduit 9. It is recovered in recovery means 18, in communication with conduit 9, as a product of the process of this invention.

The second residual fraction is conducted by conduit 15 into a second cracking reaction zone 10. The cracking zone 10, preferably a cracking reactor, is simultaneously fed a second stream, a recycle stream, entering through the downstream end of a conduit in communication with it, conduit 29. This recycle stream is comprised of the same hydrogen donating material fed into the first cracking zone 8 through conduit 31. The hydrogen donating material flow rate is such that at least 0.25 part by weight of hydrogen donating material is supplied to zone 8 per part by weight of second residual fraction. More preferably, the hydrogen donating material to second residual fraction is fed in weight ratio of at least 0.4 parts per part of second residual fraction. The second residual fraction and the hydrogen donating stream constitute the second reaction mixture.

In another perferred embodiment, the second reaction mixture includes a third constituent, gaseous hydrogen. In this preferred embodiment gaseous hydrogen is supplied at a rate such that it comprises between 0.005 to 0.05 part by weight based on the total weight of the second reaction mixture. The hydrogen 28 is supplied into the second cracking reaction zone 10 by means of conduit 53 in communication with the cracking reactor 10.

The reactants in the cracking reactor 10 are heated at a temperature in the range of between 250° and 800° C., more preferably, between 300° and 600° C. and most preferably, between 400° and 450° C., for a period in the range of between 15 seconds to 5 hours. More preferably, the total residence time in the reactor 10, is from 1 minute to 5 hours. Most preferably, the residence time is in the range of between 5 minutes and 2 hours. The pressure in the second cracker 10 is maintained in the range of between 30 and 200 atmospheres. More preferably, the pressure in the reactor 10 is in the range of between 40 and 100 atmospheres.

The product of this reaction is a second cracked product stream. This second product cracked product stream exits the second cracking reactor 10 by way of conduit 19, through which the stream is transmitted to a third separator 6. The separator 6, preferably a distillation column, separates the second cracked product stream into three streams.

One of the streams, a third middle distillate fraction, is conveyed from the separator 6 through conduit 21. This third middle distillate fraction, having a boiling temprature, at atmospheric pressure, in the range of between 175° and 300° C., along with the second middle distillate fraction, in conduit 13, and a fourth middle distillate fraction to be discussed further hereinafter, flowing in conduit 33, also having a boiling temperature, at atmospheric pressure, in the range of between 175° and 300° C. are conveyed into a hydrogenation zone 14 through conduits 13, 21 and 33, respectively (not shown). In another preferred embodiment, illustrated in FIG. 1, the second, third and fourth middle distillate fractions are combined, in combining means 12, to form a middle distillate stream and this stream is transmitted through conduit 25 into the hydrogenation zone 14.

A second stream, coming from the separator to a third residual fraction, having an initial boiling temperature of at least 425° C., is transported from the separation zone 6 through conduit 23. Its ultimate disposition is discussed hereinafter.

The third stream leaving the third separator 6 is a second distillate hydrogen enriched stream. The second distillate hydrogen enriched stream has an initial boiling temperature, at atmospheric pressure, in the range of between 40° and 540° C. It is removed from the separator 6 through a conduit 17 in communication with recovery means 18. The second distillate hydrogen enriched stream is removed as a product of the process of this reaction.

Recovery meas 18, into which the first and second distillate hydrogen enriched streams flow as products of the process of this invention may be one or more storage vessels, a piping or conduit network in communication with storage vessels or the like.

The hydrogenation zone 14 is a reactor in which the second, third and fourth middle distillate fractions or, in an alternate preferred embodiment, the middle distillate stream is fed through conduit 25. In addition, a stream of gaseous hydrogen 30 is introduced into the hydrogenation zone 14 through a conduit 35. Preferably 0.005 to 0.40 part by weight of gaseous hydrogen is fed into the hydrogenation zone 14 per part of total middle distillate fractions or middle distillate stream. The middle distillate fractions or stream is reacted with the hydrogen in the zone 14 in the presence of a solid base metal catalyst. The hydrogenation reaction is carried out at a pressure of at least 30 atmospheres, more preferably at least 50 atmospheres. Preferred solid base metal catalysts include nickel-molybdenum and cobalt-molybdenum. In a preferred embodiment, the hydrogenation zone 14 comprises a fixed bed reactor. In another preferred embodiment, the zone 14 is a fluidized bed reactor.

The product of the hydrogenation reaction, occurring in the hydrogenation reaction zone 14, is a hydrogen donating stream. This stream is characterized by the inclusion of at least 30% by weight of two and three ring hydroaromatics having ten to twenty carbon atoms per molecule. More preferably, the stream includes at least 50% by weight of two and three ring hydroaromatics having ten to twenty carbon atoms per molecule.

This hydrogen donating stream is removed from the hydrogenation reaction zone 14 through conduit 27. Conduit 27 branches into two conduits, conduits 29 and 31. As stated above conduits 29 and 31 supply recycle hydrogen donating streams. Conduit 31 feeds hydrogen donating material to the first cracking reaction zone 8 and conduit 29 feeds this same material to the second cracking reaction zone 10.

Returning now to a consideration of the fourth middle distillate fraction, it is provided by the dehydroisomerization of the first middle distillate fraction, separated from the heavy carbonaceous liquid feedstock 3 in the separating zone 2. This first middle distillate fraction having a boiling temperature, at atmospheric pressure, in the range of between 175° and 300° C. is removed from separator 2 through conduit 5 into a dehydroisomerizing zone 20.

Depending upon the composition of the liquid feedstock 1, it may be advantageous to include a desulfurization step, known to those skilled in the art, to remove sulfur and sulfur containing constituents from the first middle distillate stream. Therefore, in a preferred embodiment, shown in FIG. 1, desulfurization zone 34 is provided. The desulfurized first middle distillate stream is, in this embodiment, conveyed to the dehydroisomerization zone 20 in conduit 55.

The dehydroisomerization zone 20 comprises a dehydroisomerization reactor. In the dehydroisomerization step, conducted in the dehydroisomerization reactor, higher hydrocarbons in the first middle distillate fraction, that is, hydrocarbons of ten or more carbon atoms per molecule, are catalytically dehydroisomerized in the presence of hydrogen 32, provided to the dehydroisomerization reactor 20 through conduit 39. The catalyst, a reforming catalyst, employed is preferably selected from the group consisting of molybdenum on alumina, chromium on alumina and platinum on alumina.

The product of this dehydroisomerizing reaction is the fourth middle distillate fraction mentioned above. This fraction is rich in two and three ring aromatics and two and three ring alkylaromatics which represent at least 30% by weight of the fourth middle distillate fraction. More preferably, the multiple ring aromatic and alkylaromatics, which have ten to twenty carbon atoms per molecule, represent at least 50% by weight of the fourth middle distillate fraction.

The presence of these two and three ring aromatics and alkylaromatics permits the conversion of the combined middle distillate stream during hydrogenation to produce at a rate to render the process in material balance the unique hydrogen donating material rich in two and three ring hydroaromatics having ten to twenty carbon atoms per molecule employed as reactants in the first and second reaction mixtures fed into the first and second cracking reactors 8 and 10 respectively of this invention.

It may happen that the dehydroisomerization reaction may result in the formation of two and three ring aromatics and alkylaromatics constituting less than 30% by weight of fourth middle distillate fraction. If this occurs those skilled in the art will appreciate that separation techniques, such as distillation, will be employed to remove other components so that the concentration of the fourth middle distillate stream entering the hydrogenation step includes at least 30% by weight of two and three ring aromatics having ten to twenty carbon atoms per molecule.

This possibility is provided for in the embodiment illustrated in FIG. 1. A separating means 36, preferably a distillation column, communicates with the fourth middle distillate fraction removed from the dehydroisomerizing means 20 through conduit 57. In the separator 36 non-aromatics and non-alkylaromatics are removed through conduit 59 so that the unremoved portion of the stream includes at least 30% by weight of two and three ring aromatics having ten to twenty carbon atoms per molecule.

The third residual product stream, as stated above, removed from the third separating unit 6 through conduit 23, in a preferred embodiment, communicates with a conduit 41 through which it is transmitted to a partial oxidation unit 22. The partial oxidation unit 22, comprises reaction equipment, well known to those skilled in the art, to produce as a product of this partial oxidation process, hydrogen. This hydrogen leaves the unit 22 through conduit 43. This gaseous hydrogen is preferably employed as feed to those reactors in which hydrogen is employed as a reactant, thus further optimizing the process of this invention.

In another preferred embodiment, the conduit 23, conducting the third residual product stream from a separator 6, communicates with a conduit 45. The conduit 45 transmits the third residual product stream to a coking unit 24. The third residual product stream is processed in the unit 24, by a standard coking process, known to those skilled in the art, to produce gaseous hydrocarbons and distillate fuels depicted in FIG. 1 as exiting through conduits 47 and 49, respectively. Again, the gaseous hydrocarbons produced in this coking reaction are employed as fuel and hydrogen-feedstock for this process.

In yet another preferred embodiment, illustrated in FIG. 1, the third residual product stream in conduit 23 is fed into both conduits 41 and 45, resulting in the partial oxidation of a part of the third residual fraction and the coking of the remainder.

Figure 2:
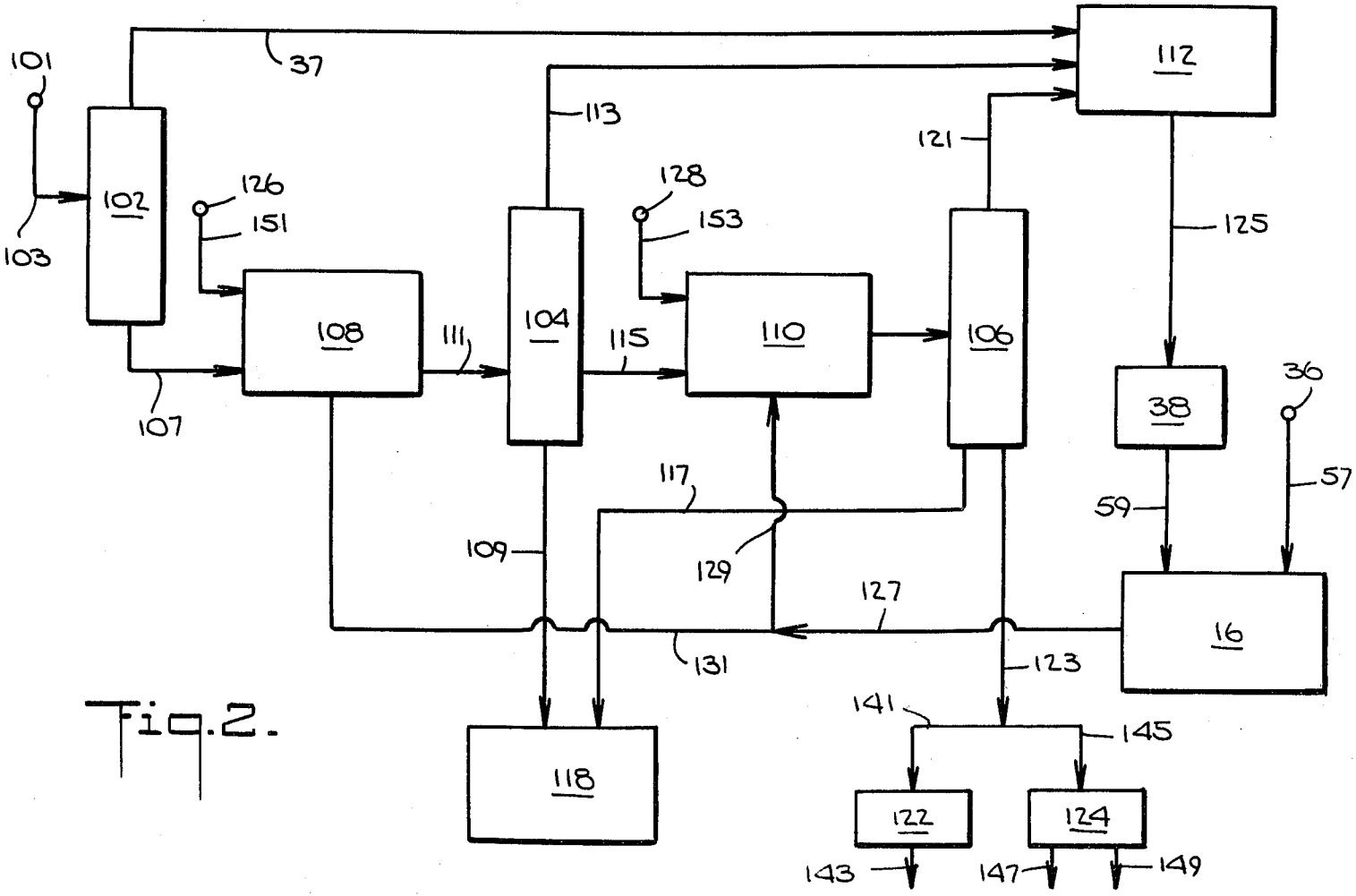
FIG. 2 is a schematic representation of another preferred embodiment of the process of the instant invention.

In another perferred embodiment of the process of the present invention, illustrated in FIG. 2, the hydrogenation and dehydroisomerization steps of the process of this invention, employed in the preferred embodiment depicted in FIG. 1, is replaced by a single hydroisomerization step.

It is unnecessary to recite all the steps that make up the preferred embodiment pictorially shown in FIG. 2. Rather, it is submitted that the preferred embodiment of FIG. 1, is repeated in the embodiment of FIG. 2 except for those steps to be discussed hereinafter.

To emphasize this similarity, it is noted that the reference numerals used in FIG. 2 for those reactors, zone, conduits, feed sources and the like which are the same as in the embodiment of FIG. 1 are given the number 100 plus the reference number applied in FIG. 1. For example, the liquid carbonaceous feed 1 of FIG. 1 is assigned reference number 101 in FIG. 2.

It is reiterated that the hydrogenation step which is conducted in hydrogenation zone 14, the dehydroisomerization step, which takes place in the dehydroisomerization zone 20, and the desulfurization step, if included, occurring in desulfurization zone 34, are omitted in the preferred embodiment of the process of this invention set out in FIG. 2. In its place is a hydroisomerization step which is conducted in hydroisomerization zone 16 and optionally a desulfurization step, carried out in a desulfurization zone 38.

In this second preferred embodiment the first middle distillate fraction, one of the two fractions of the liquid carbonaceous feedstock 101, separated in first separator 102, is fed directly, through conduit 37, in one preferred embodiment (not shown) to the hydroisomerization zone 16. In another preferred embodiment, depicted in FIG. 2, the first middle distillate fraction is combined with the second and third middle distillate fractions in combining means 112 to form a middle distillate stream.

As in the previously described embodiment, a desulfurization step may be preferably employed in those cases where the incoming feedstock includes sulfur or sulfur containing materials. In case such a step is included, a desulfurization reaction zone 38 is provided. Either separate conduits conducting the first, second and third distillate fractions communicate with this stream or, alternately, as depicted in FIG. 2, the single combined middle distillate stream, in conduit 125 communicates with the desulfurization reaction zone 38. In that zone, sulfur and sulfur containing constituents in the middle distillate are removed.

Either the untreated or, in the preferred embodiment shown in the drawings, the desulfurized middle distillate stream is conducted into the hydroisomerization reaction zone 16. Simultaneously, a second reactant gaseous hydrogen 36 is fed into the zone 16 by way of conduit 57. Gaseous hydrogen is introduced into the hydroisomerization reactor 16 in a concentration in the range of between 0.005 and 0.40 part hydrogen per part of middle distillate material. The reaction of the middle distillate stream and gaseous hydrogen is a catalytically initiated one in which solid acidic catalyst is present. Preferred acidic catalysts for use in the hydroisomerization step include, but are not limited to, silica, alumina and phosphoric acid on kieselguhr.

The product of the hydroisomerization reaction occurring in zone 16 is hydrogen donating material. This material is characterized by a high concentration of two and three ring hydroaromatics having ten to twenty carbon atoms per molecule. That concentration represents at least 30% by weight of the total hydrogen donating material, more preferably, at least 50% by weight. As illustrated in the drawing the hydrogen donating material is recycled to the first and second cracking reactors 108 and 110 as in the first preferred embodiment.

It should be appreciated that the temperatures, pressures, concentrations, residence times and the like set forth in the description of the preferred embodiment of FIG. 1 applies to the embodiment of FIG. 2 unless contradicted by the above abbreviated description of the preferred embodiment of FIG. 2.

The above preferred embodiments will make apparent, to those skilled in the art, other embodiments and examples within the scope and spirit of the instant invention. These suggested embodiments and examples are within the contemplation of this invention. The invention, therefore, should be limited only by the appended claims.

What is claimed is:

1. A process for the cracking of a carbonaceous liquid feedstock comprising the steps of:

(a) separating a carbonaceous liquid feedstock into a first middle distillate fraction, having a boiling temperature, at atmospheric pressure, in the range of between 175° and 300° C. and a first residual fraction, having an initial boiling temperature, at atmospheric pressure, in the range of between 260° and 540° C.;

(b) supplying a first reaction mixture comprising a recycle stream of hydrogen-donating material and said first residual fraction, recovered from step (a), to a first cracking reaction zone;

(c) reacting said first reaction mixture in said first cracking reaction zone at a temperature in the range of between 250° and 800° C. and a pressure in the range of between 30 and 200 atmospheres for a period in a range of between 15 seconds and 5 hours whereby a first cracked product stream is obtained;

(d) separating said first cracked product stream into a second middle distillate fraction having a boiling temperature, at atmospheric pressure, in the range of between 175° and 300° C., a second residual fraction having an initial boiling temperature, at atmospheric pressure, in the range of between 260° and 540° C., and a first distillate hydrogen enriched stream having an initial boiling temperature, at atmospheric pressure, in the range of between 40° and 540° C.;

(e) supplying a second reaction mixture comprising a recycle stream of hydrogen-donating material and said second residual fraction, recovered in step (d), to a second cracking reaction zone;

(f) reacting said second reaction mixture in said second cracking rection zone at a temperature in the range of between 250° and 800° C. and a pressure in the range of between 30 and 200 atmospheres for a period in the range of between 15 seconds and 5 hours whereby a second cracked product stream is obtained;

(g) separating said second cracked product stream into a third middle distillate fraction, having a boiling temperature, at atmospheric pressure, in the range of between 175° and 300° C., a third residual fraction having an initial boiling temperature, at atmospheric pressure, of at least 425° C. and a second distillate hydrogen enriched stream having an initial boiling temperature, at atmospheric pressure, in the range of between 40° and 540° C.;

(h) dehydroisomerizing said first middle distillate fraction in the presence of gaseous hydrogen and a reforming catalyst whereby a fourth middle distillate fraction is formed and comprises at least 30% by weight of two and three ring aromatics having ten to twenty carbon atoms per molecule;

(i) hydrogenating said second, said third and said fourth middle distillate fractions in the presence of gaseous hydrogen and a solid base metal catalyst whereby a hydrogen-donating material comprising at least 30% by weight of 2-ring hydroaromatics having ten to twenty carbon atoms per molecule is formed;

(j) recycling said hydrogen donating material formed in step (i), to said first cracking reaction zone, in accordance with step (b), and to said second cracking reaction zone, in accordance with step (e); and (k) recovering said first distillate hydrogen enriched stream and said second distillate hydrogen enriched stream as products.

2. A process in accordance with claim 1 including the step of partially oxidizing said third residual fraction.

3. A process in accordance with claim 1 including the step of coking said third residual fraction.

4. A process in accordance with claim 1 including the step of dividing said third residual fraction into two streams, one such stream of which is partially oxidized and the other stream of which is coked.

5. A process in accordance with claim 1 wherein said recycle stream of hydrogen donating material is introduced into said first cracking reaction zone at a weight ratio of at least 0.25 part per part of said first residual fraction.

6. A process in accordance with claim 5 wherein at least 0.4 part by weight of said hydrogen donating material is introduced into said first cracking reaction zone per part by weight of said first residual fraction.

7. A process in accordance with claim 5 wherein said recycle stream of hydrogen donating material is introduced into said second cracking reaction zone at a weight ratio of at least 0.25 part per part of said second residual fraction.

8. A process in accordance with claim 7 wherein at least 0.4 part by weight of said hydrogen donating material is introduced into said second cracking reaction zone per part by weight of said second residual fraction.

9. A process in accordance with claim 1 wherein said first cracking reaction mixture is reacted in said first cracking reaction zone at a temperature in the range of between 300° C. and 600° C., and a pressure of between 40 and 100 atmospheres for a period in the range of between 1 minute and 4 hours.

10. A process in accordance with claim 9 wherein said second cracking reaction mixture is reacted in said second cracking reaction zone at a temperature in the range of between 300° and 600° C. and a pressure of between 40 and 100 atmospheres for a period in the range of between 1 minute and 4 hours.

11. A process in accordance with claim 1 wherein gaseous hydrogen is included in said first reaction mixture introduced into said first cracking reaction zone.

12. A process in accordance with claim 11 wherein gaseous hydrogen is included in said second reaction mixture introduced into said second cracking reaction zone.

13. A process in accordance with claim 1 comprising the step of desulfurizing said first middle distillate fraction prior to dehydroisomerizing said first middle distillate fraction.

14. A process in accordance with claim 1 comprising the removal of material other than two and three ring aromatics having ten to twenty carbon atoms per molecule from said dehydroisomerized fourth middle distillate fraction whereby said fourth middle distillate fraction includes at least 30% by weight of said two and three ring aromatics having ten to twenty carbon atoms per molecule.

15. A process in accordance to claim 1 wherein said dehydroisomerized fourth middle distillate fraction comprises at least 50% by weight of said two and three ring aromatics having ten to twenty carbon atoms per molecule.

16. A process in accordance with claim 15 comprising the removal of non-two and three ring aromatics having ten to twenty carbon atoms per molecule from said dehydroisomerized fourth middle distillate friction whereby said fourth middle distillate fraction includes at least 50% by weight of said two and three ring aromatics having ten to twenty carbon atoms per molecule.

17. A process in accordance with claim 1 wherein said hydrogen donating material comprises at least 50% by weight of said two and three ring hydroaromatics having ten to twenty carbon atoms per molecule.

18. A process in accordance with claim 1 wherein said solid base catalyst used in said hydrogenation step is selected from the group consisting of nickel-molybdenum and cobalt-molybdenum.

19. A process in accordance with claim 18 wherein said reforming catalyst employed in said dehydroisomerizing step is selected from the group consisting of molybdenum on alumina, chromium on alumina and platinum on alumina.

20. A process for the cracking of a carbonaceous liquid feedstock comprising the steps of:

(a) separating a carbonaceous liquid feedstock into a first middle distillate fraction, having a boiling temperature, at atmospheric pressure, in the range of between 175° and 300° C. and a first residual fraction, having an initial boiling temperature, at atmospheric pressure, in the range of between 260° and 540° C.;

(b) supplying a first reaction mixture comprising a recycle stream of hydrogen donating material and said first residual fraction, recovered in step (a), to a first cracking reaction zone;

(c) reacting said first reaction mixture in said first cracking reaction zone at a temperature in the range of between 250° and 800° C. and a pressure in the range of between 30 and 200 atmospheres for a period in the range of between 15 seconds and 5 hours whereby a first cracked product stream is obtained;

(d) separating said first cracked product stream into a second middle distillate fraction having a boiling temperature, at atmospheric pressure, in the range of between 175° and 300° C., a second residual fraction having an initial boiling temperature, at atmospheric pressure, in the range of between 260° and 540° C. and a first distillate hydrogen enriched stream having an initial boiling temperature, at atmospheric pressure, in the range of between 40° and 540° C.;

(e) supplying a second reaction mixture comprising a recycle stream of hydrogen donating material and said second residual fraction, recovered in step (d), to a second cracking reaction zone;

(f) reacting said second reaction mixture in said second cracking reaction zone at a temperature in the range of between 250° and 800° C. and a pressure in the range of between 30 and 200 atmospheres for a period in the range of between 15 seconds and 5 hours whereby a second cracked product steam is obtained;

(g) separating said second cracked product stream into a third middle distillate fraction having a boiling temperature, at atmospheric pressure, in the range of between 175° and 300° C., a third residual fraction having an initial boiling temperature, at atmospheric pressure, of at least 425° C. and a second distillate hydrogen enriched stream having an initial boiling temperature in the range of between 40° and 540° C.;

(h) hydroisomerizing said first, said second and said third middle distillate fractions in the presence of gaseous hydrogen and a solid catalyst whereby a hydrogen donating material comprising at least 30% by weight of two and three ring hydroaromatics having ten to twenty carbon atoms per molecule is formed;

(i) recycling said hydrogen donating material, formed in step (h), to said first cracking reaction zone, in accordance with step (b), and to said second cracking reaction zone, in accordance with step (e); and (j) recovering said first distillate hydrogen enriched product stream and said second distillate hydrogen enriched product steam.

21. A process in accordance with claim 20 including the step of partially oxidizing said third residual fraction.

22. A process in accordance with claim 20 including the step of coking said third residual fraction.

23. A process in accordance with claim 20 including the step of dividing said third residual fraction into two streams, one such stream of which is partially oxidized and the other stream of which is coked.

24. A process in accordance with claim 20 wherein said recycle stream of hydrogen donating material is introduced into said first cracking reaction zone at a weight ratio of at least 0.25 part per part of said first residual fraction.

25. A process in accordance with claim 24 wherein at least 0.4 part by weight of said hydrogen donating material is introduced into said first cracking reaction zone per part by weight of said first residual fraction.

26. A process in accordance with claim 24 wherein said recycle stream of hydrogen donating material is introduced into said second cracking reaction zone at a weight ratio of at least 0.25 part per part of said second residual fraction.

27. A process in accordance with claim 26 wherein at least 0.4 part by weight of said hydrogen donating material is introduced into said second cracking reaction zone per part of said second residual fraction.

28. A process in accordance with claim 20 wherein said first cracking reaction mixture is reacted in said first cracking reaction zone at a temperature in the range of between 300° and 600° C. and a pressure in the range of between 40 and 100 atmospheres for a period in the range of between 1 minute and 4 hours.

29. A process in accordance with claim 28 wherein said second cracking reaction mixture is reacted in said second cracking reaction zone at a temperature in the range of between 300° and 600° C. and a pressure in the range of between 40 and 100 atmospheres for a period in the range of between 1 minute and 4 hours.

30. A process in accordance with claim 20 wherein gaseous hydrogen is included in said first reaction mixture introduced into said first cracking reaction zone.

31. A process in accordance with claim 30 wherein gaseous hydrogen is included in said second reaction mixture introduced into said second cracking reaction zone.

32. A process in accordance with claim 20 wherein said hydrogen donating material comprises at least 50% by weight of said two and three ring hydroaromatics having ten to twenty carbon atoms per molecule.

33. A process in accordance with claim 20 wherein said hydroisomerization is a solid acidic catalyst selected from the group consisting of silica, alumina and phosphoric acid on Kieselguhr.

34. A process in accordance with claim 20 comprising the step of desulfurizing said first said second and said third middle distillate fractions prior to said hydroisomerizing of said fractions.

* * * * *